US005810017A

United States Patent [19]

Watanabe et al.

[11] Patent Number: 5,810,017

[45] Date of Patent: Sep. 22, 1998

[54] SUPPLYING DEVICE FOR SUPPLYING SHREDDED TOBACCO TO ROD FORMING SECTION OF CIGARETTE MANUFACTURING MACHINE

[75] Inventors: Tomoichi Watanabe; Tohru Kanoh, both of Tokyo, Japan

[73] Assignee: Japan Tobacco Inc., Tokyo, Japan

[21] Appl. No.: 950,783

[22] Filed: Oct. 15, 1997

[30] Foreign Application Priority Data

Oct. 15, 1996 [JP] Japan ..... 8-272389

[51] Int. Cl.[6] ..... A24C 5/18

[52] U.S. Cl. ..... 131/84.1; 131/84.2

[58] Field of Search ..... 131/84.1, 84.2, 131/84.3, 84.4, 109.1, 280

[56] References Cited

U.S. PATENT DOCUMENTS 3,626,953 12/1971 Korber ..... 131/22
5,337,761 8/1994 Okumoto ..... 131/84.1
5,622,189 4/1997 Dawson et al. ..... 131/84.1

FOREIGN PATENT DOCUMENTS 440484 1/1936 United Kingdom ..... 131/84.1
2272828 6/1994 United Kingdom ..... 131/84.1

*Primary Examiner*—John G. Weiss
*Assistant Examiner*—Charles W. Anderson
*Attorney, Agent, or Firm*—Birch, Stewart, Kolasch & Birch, LLP

[57] ABSTRACT

A supplying device of shredded tobacco has a conveying unit arranged between a first tobacco band and a second tobacco band. The conveying unit has a reforming passage. When a first layer of the shredded tobacco is supplied from the first tobacco band into the reforming passage, the shredded tobacco of the first layer is dispersed within the reforming passage. Thereafter, the shredded tobacco in the reforming passage is deposited on a bottom face of the reforming passage and forms a second layer of the shredded tobacco. The second layer is supplied from the conveying unit to a rod forming section of a cigarette manufacturing machine through the second tobacco band.

8 Claims, 5 Drawing Sheets

SUPPLYING DEVICE FOR SUPPLYING SHREDDED TOBACCO TO ROD FORMING SECTION OF CIGARETTE MANUFACTURING MACHINE

BACKGROUND OF THE INVENTION

1. Field of the Invention

The present invention relates to a device for supplying shredded tobacco to the rod forming section of a cigarette manufacturing machine.

2. Description of the Related Art

A cigarette must be excellent in physical properties as well as a smoking taste such as flavor and savor, etc. Further, the cigarette must be excellent in cost.

For example, U.S. Pat. No. 5,337,761 discloses a shredded tobacco supplying device for a cigarette manufacturing machine to improve the physical properties of a cigarette and reducing cost of the cigarette.

If such a shredded tobacco supplying device is used, an improved tobacco rod formed in the rod forming section of the cigarette manufacturing machine has an arrangement of the shredded tobacco different from that of the normal tobacco rod. More particularly, in the case of the normal tobacco rod, a large part of the shredded tobacco is perpendicularly laminated to the axis of the tobacco rod. In contrast to this, in the case of the improved tobacco rod, a large part of the shredded tobacco is laminated along the axial direction of the tobacco rod, that is, the shredded tobacco is radially arranged in transverse cross section of the tobacco rod.

In accordance with the improved tobacco rod, since a large part of the shredded tobacco is radially arranged as mentioned above, the tobacco rod is strong against compression force from the exterior and its external appearance is not easily deformed. Therefore, when the physical properties of the normal tobacco rod, i.e., a mechanical strength approximately equal to that of the normal tobacco rod is obtained, a filling density of the shredded tobacco can be reduced in the improved tobacco rod. As a result, in accordance with the improved tobacco rod, the mechanical strength of the tobacco rod, i.e., the cigarette is increased and a required filling amount of the shredded tobacco can be also reduced.

When cigarettes are obtained by cutting the improved tobacco rod, however, holding force of the shredded tobacco provided by the wrapping paper thereof is weak at the cutting ends of the cigarette, because the large part of the shredded tobacco is radially arranged in transverse section of the tobacco rod as mentioned above. Therefore, the shredded tobacco tends to be easily dropped from cutting ends of the cigarette and the filter cigarette when manufacturing thereof, and a distributing process of the cigarette pack containing the cigarettes or the filter cigarettes. Accordingly, the physical properties of the cigarette or the filter cigarette become worse in this respect.

On the other hand, in the case of the supplying device, the shredded tobacco layer is compressed at a former stage of the change of the shredded tobacco arrangement. The shredded tobacco is easily crushed by such compression of the shredded tobacco layer as a driving speed of the cigarette manufacturing machine is increased. Such crushing of the shredded tobacco becomes a dropping factor of the shredded tobacco from the cutting ends.

SUMMARY OF THE INVENTION

An object of the present invention is to provide a shredded tobacco supplying device capable of reducing a required amount of shredded tobacco and improving the physical properties of a cigarette and coping with a high speed operation of a cigarette manufacturing machine.

The above object is achieved by a shredded tobacco supplying device of the present invention, the supplying device comprising: first conveying means for conveying a first layer of shredded tobacco, first conveying means including a first movable suction surface on which the first layer is formed in a layer form by sucking the shredded tobacco; reforming means for receiving the first layer from the first suction surface of the first conveying means and reforming the first layer into a second layer thicker than the first layer, the reforming means including a passage for forming the second layer by dispersing the received shredded tobacco of the first layer and depositing the shredded tobacco after dispersion and moving means for moving the second layer formed in the passage; and second conveying means for receiving the second layer from the reforming means and conveying the second layer toward a rod forming section for tobacco rod, the second conveying means including a second movable suction surface onto which the second layer is sucked.

In accordance with the above supplying device, the shredded tobacco of the first layer supplied from the first suction surface of the first conveying means to the reforming means is dispersed within the passage of the reforming means. More specifically, the lamination of the shredded tobacco in the first layer is released within the passage. The individual shredded tobacco is scattered within the passage and is deposited on a bottom face of the passage so that the second layer of the shredded tobacco is formed. The shredded tobacco in the second layer is not laminated in a layer form so that the individual shredded tobacco is oriented to an irregular direction.

The second layer of the shredded tobacco is received from the reforming means onto the second suction surface of the second conveying means and is then conveyed toward the rod forming section together with the second suction surface. Thereafter, the second layer is wrapped in paper in the rod forming section and is formed as a tobacco rod. The formed tobacco rod is continuously sent from the rod forming section.

As mentioned above, since the individual shredded tobacco in the second layer is oriented to an irregular direction, shredded tobaccos in the formed tobacco rod are in a state in which these shredded tobaccos are entwined with each other and are reliably held by paper. Therefore, hardness of the tobacco rod is uniformed in a circumferential direction thereof and is increased in comparison with the hardness of the normal tobacco rod. Here, the normal tobacco rod is formed by wrapping the first layer of the shredded tobacco in paper.

Accordingly, when the same hardness as the normal tobacco rod is approximately obtained, a filling amount of the shredded tobacco in the tobacco rod can be reduced.

The formed tobacco rod is cut into a cigarette rod having a predetermined length. Since the shredded tobacco in the tobacco rod is in the mutually entwining state as mentioned above, it is possible to reduce dropping of the shredded tobacco from cutting ends of the tobacco rod and the cigarette rod when cutting thereof and in subsequent manufacturing process and distributing stage. As a result, the filling amount of the shredded tobacco in the tobacco rod can be reduced and the dropping of the shredded tobacco from the cutting ends can be simultaneously prevented.

When the first layer of the shredded tobacco is reformed into the second layer, no compression action is applied to the first layer. Therefore, no shredded tobacco in the first layer is crushed and dropping of the shredded tobacco caused by this crushing can be also prevented.

The above-mentioned moving means includes a suction band forming one side wall of the passage. This suction band attracts the second layer of the shredded tobacco reformed within the passage and conveys the second layer toward the second suction surface of the second conveying means in accordance with a movement of the suction band.

Both side walls of the passage can be respectively formed by suction bands. One of the side walls may be formed by the suction band and the other side wall may be formed by a guide wall.

Further, the passage has a constant width from its inlet to an outlet, or the width of the inlet of the passage is increased in comparison with the width of the outlet. In this case, a space required to disperse the shredded tobacco of the first layer can be sufficiently secured.

The first conveying means further includes a trimming means for adjusting a thickness of the first layer. In this case, the introducing rate of the shredded tobacco into the passage is stabilized.

The traveling speed of the second layer provided by the moving means is lower than the traveling speed of the first layer provided by the first suction surface. The traveling speed of the second layer in the passage is equal to or higher than the traveling speed of the second layer provided by the second suction surface. In this case, the shredded tobacco can be preferably scattered within the passage and the reformed second layer is reliably received on the second suction surface of the second conveying means.

Further scope of applicability of the present invention will become apparent from the detailed description given hereinafter. However, it should be understood that the detailed description and specific example, while indicating preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

Figure 1:
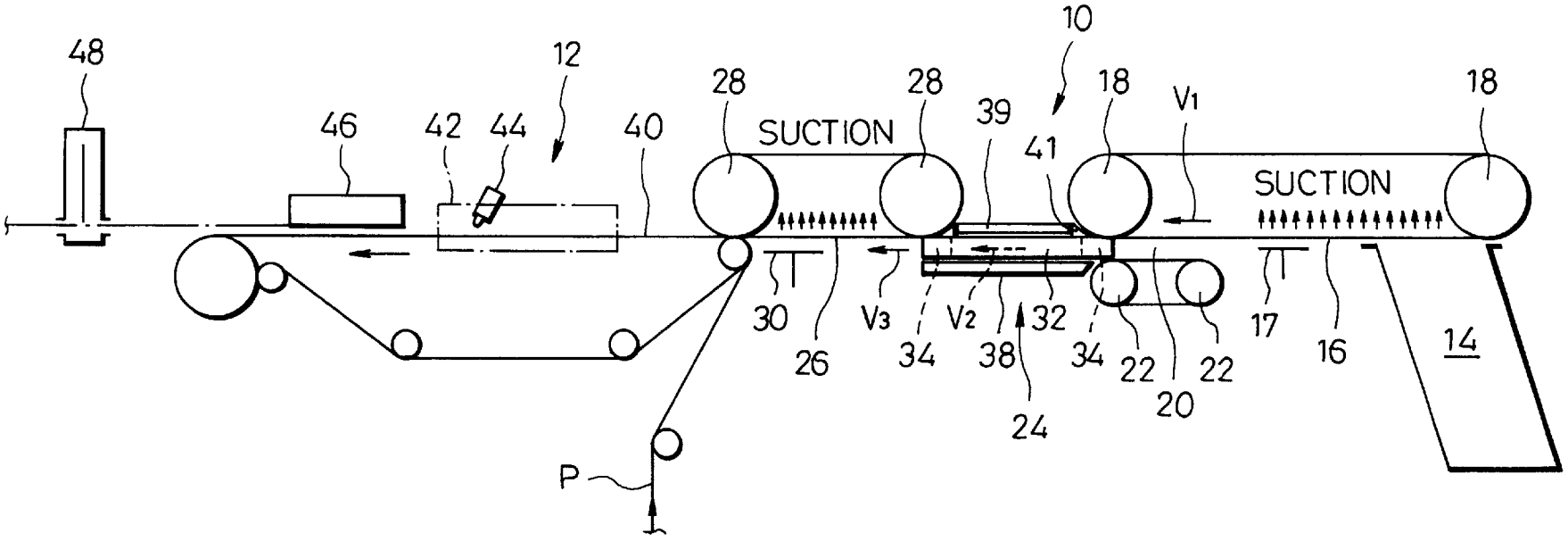
FIG. 1 is a schematic view of a cigarette manufacturing machine including a shredded tobacco supplying device according to the present invention.

With reference to FIG. 1, a cigarette manufacturing machine mainly has a supplying device 10 of shredded tobacco and a rod forming section 12 for receiving shredded tobacco supplied from the supplying device 10 and continuously forming a tobacco rod. In FIG. 1, the rod forming section 12 is arranged such that the rod forming section 12 is adjacent to a left-hand side of the supplying device 10.

The supplying device 10 has a chimney 14. The chimney 14 receives the shredded tobacco supplied from a supplying drum (not shown) at a lower end of the chimney. The shredded tobacco in the chimney 14 is raised together with the air flow in the chimney 14.

A first tobacco band 16 is arranged just above an upper end opening of the chimney 14. The first tobacco band 16 extends toward the rod forming section 12. A lower surface of the first tobacco band 16 attracts the shredded tobacco raised to the upper end opening of the chimney 14 in a layer shape. Therefore, a first layer (see FIG. 2) of the shredded tobacco formed on the lower surface of the first tobacco band 16 is supplied from the chimney 14 to the rod forming section 12 in accordance with traveling of the first tobacco band 16. More particularly, the first tobacco band 16 is one run of an endless suction belt extended between a pair of drums 18 and passed around the drums 18. The suction belt, i.e., the first tobacco band 16 travels at a predetermined traveling speed $V_1$ in the direction of an arrow shown in FIG. 1 as these drums 18 are rotated.

The first tobacco band 16 is provided with a first trimming device. The first trimming device has a pair of trimming disks 17 arranged on a lower side of the first tobacco band 16. These trimming disks 17 adjust the first layer on the first tobacco band 16 to a predetermined thickness $T_1$. Namely, the thickness $T_1$ of the first layer supplied to the rod forming section 12 is determined by a gap between the pair of trimming disks 17 and the first tobacco band 16. This gap can be adjusted by displacing the pair of trimming disks 17 or a portion of the first tobacco band 16 located just above these trimming disks 17 in a vertical direction.

Here, the traveling speed $V_1$ of the first tobacco band 16 is sufficiently higher than a traveling speed of the normal tobacco band. A suction drum can be also used instead of the first tobacco band 16. In this case, the first layer of the shredded tobacco is formed on an outer circumferential surface of the suction drum, i.e., a suction surface and then is supplied to the rod forming section 12 as the suction drum is rotated.

The first tobacco band 16 is further provided with a collecting band 20. The collecting band 20 is arranged below a terminal end region in the first tobacco band 16. The collecting band 20 travels in the same direction as the first tobacco band 16 at the same traveling speed as the first tobacco band 16. More particularly, the collecting band 20 is one portion of an endless belt extended between a pair of rollers 22 and passed around them.

The collecting band 20 has the same width as the first tobacco band 16. A clearance sufficiently wider than the thickness of the first layer formed on the first tobacco band 16 is secured between the collecting band 20 and the first tobacco band 16. For example, this clearance is set to be about twice the thickness of the first layer. Therefore, the collecting band 20 never comes in contact with the first layer on the first tobacco band 16. The collecting band 20 receives the shredded tobacco dropped off the first layer and conveys this shredded tobacco together with traveling of the collecting band 20.

The collecting band 20 is supported by an unillustrated elevating mechanism and can be moved in a vertical direction. The vertical movement of the collecting band 20 adjusts the clearance between the collecting band 20 and the first tobacco band 16.

A second tobacco band 26 is connected to a left-hand side of the first tobacco band 16 seen from FIG. 1 through a conveying unit 24. The conveying unit 24 and the second tobacco band 26 are aligned with each other on the same line as the first tobacco band 16 and are substantially located on the same traveling plane. The conveying unit 24 receives the first layer from the first tobacco band 16 and reforms the first layer into a second layer. Thereafter, this second layer is supplied, i.e., traveled toward the second tobacco band 26.

Here, an arrangement of the shredded tobacco in the second layer is different from that in the first layer and a traveling speed $V_2$ of the second layer in the conveying unit 24 is lower than the traveling speed $V_1$ of the first layer. The conveying unit 24 will be described later in detail.

Similar to the above first tobacco band 16, the second tobacco band 26 is one run of an endless suction belt extended between a pair of drums 28 and passed around them. The second tobacco band 26 receives the second layer of the shredded tobacco from the conveying unit 24 on a lower surface of the second tobacco band 26 by suction. The second tobacco band 26 then supplies the second layer to the rod forming section 12 at a traveling speed $V_3$. The traveling speed $V_3$ of the second tobacco band 26 is equal to or lower than the traveling speed $V_2$ of the second layer.

A second trimming device is arranged in the second tobacco band 26. This second trimming device has a pair of trimming disks 30 arranged on a lower side of the second tobacco band 26. These trimming disks 30 adjust a thickness of the second layer on the second tobacco band 26 by rotating these trimming disks 30. Accordingly, the rod forming section 12 receives the second layer adjusted in thickness.

The rod forming section 12 has an endless garniture tape 40. The garniture tape 40 extends through a rod mold 42. The rod mold 42 has a paste applicator 44. Paper P and the second layer of the shredded tobacco are supplied onto the garniture tape 40 and are traveled in an arrow direction shown in FIG. 1 together with the garniture tape 40 through the rod mold 42. In this case, as is well-known, the rod mold 42 gradually wraps the second layer in the paper P with an assistance of the garniture tape 40. One side edge of the paper P is then coated with paste. When the second layer is perfectly wrapped in the paper P, both side edges of the paper P are adhered to each other so that a tobacco rod is continuously formed.

Thereafter, the formed tobacco rod sequentially passes through a dryer 46 and a cutting section 48. The dryer 46 dries the overlapped portion of the paper P in the tobacco rod and the cutting section 48 cuts the tobacco rod every predetermined length so that cigarette rod are formed.

The conveying unit 24 has a bottom wall 38 and a ceiling wall 39. The bottom wall 38 extends from the above collecting band 20 to the second tobacco band 26. An upper surface of the bottom wall 38 is located on a plane lower than traveling plane of the first and second tobacco bands 16 and 26. One end face of the bottom wall 38 on the side of the collecting band 20 is formed as a arc surface corresponding to the outer circumferential surface of the drum 22 of the collecting band 20. A discharging passage of the shredded tobacco is secured between the collecting band 20 and one end of the bottom wall 38. Therefore, the shredded tobacco on the collecting band 20 is discharged downward through the discharging passage in accordance with traveling of the collecting band 20, collected and then reused as new shredded tobacco.

Figure 2:
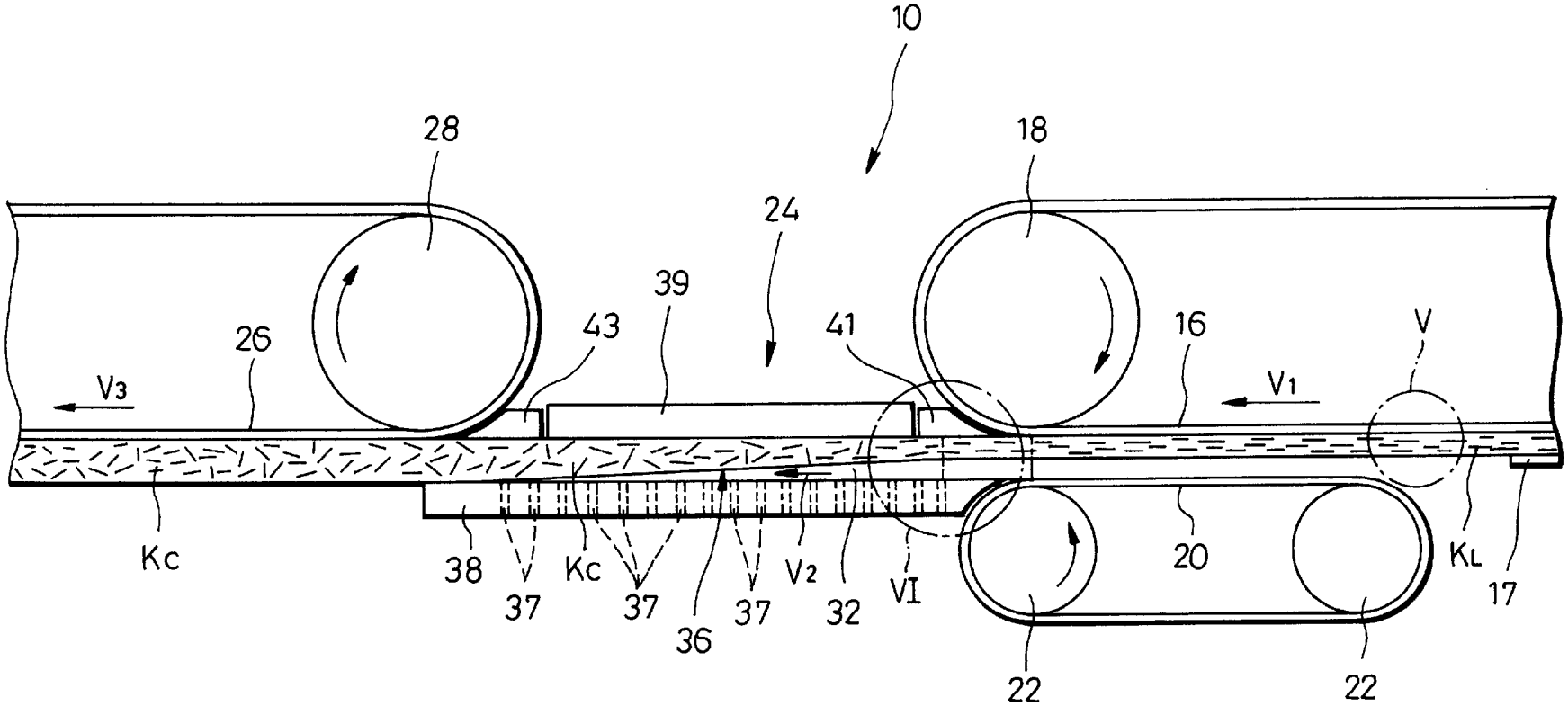
FIG. 2 is a view showing a situation in which a first layer of shredded tobacco is continuously sent from a first tobacco band into a reforming passage of a conveying unit in the supplying device and a second layer of the shredded tobacco is formed within the reforming passage.

Further, the bottom wall 38 has air permeability. As shown in FIG. 2, for example, this air permeability is provided by forming many passing holes 37 in the bottom wall 38. The passing holes 37 are uniformly distributed in the bottom wall 38 and are opened onto an upper surface of the bottom wall 38. Each of the passing holes 37 has a diameter smaller than that of the individual shredded tobacco so that no shredded tobacco drops through the passing holes 37.

The ceiling wall 39 is arranged above the bottom wall 38. A lower surface of the ceiling wall 39, i.e., a ceiling is located on the same plane as the traveling plane of the first and second tobacco bands 16 and 26.

A scraper 41 is arranged between the ceiling wall 39 and the drum 18 of the first tobacco band 16. The scraper 41 scrapes the first layer of the shredded tobacco from the lower surface of the first tobacco band 16 and guides the first layer to a space between the bottom wall 38 and the ceiling wall 39. An introducing guide 43 is arranged between the ceiling wall 39 and the second tobacco band 26. The introducing guide 43 smoothly introduces the second layer of the shredded tobacco in the conveying unit 24 to the lower surface of the second tobacco band 26. The above scraper 41 and the introducing guide 43 can be formed integrally with the ceiling wall 39.

The conveying unit 24 further has a pair of side bands 32 (see FIG. 1). The side bands 32 are respectively arranged on left-hand and right-hand sides of the ceiling wall 39 such that these side bands are parallel to each other and are opposed to each other. A clearance equal to the width of each of the first and second tobacco bands 16, 26 is secured between the side bands 32.

The pair of side bands 32, the bottom wall 38 and the ceiling wall 39 define a path from the first tobacco band 16 to the second tobacco band 26 as a reforming passage 36 (see FIG. 2) formed in a tunnel shape. Namely, the pair of side bands 32 and the walls 38 and 39 present the inside surface, the bottom face and the ceiling face of the reforming passage 36, respectively. Therefore, the reforming passage 36 has a rectangular transverse section and has a height sufficiently larger than the above thickness of the first layer of the shredded tobacco. Only a part of the side band 32 is shown to clearly illustrate the reforming passage 36 in FIG. 2.

Figure 3:
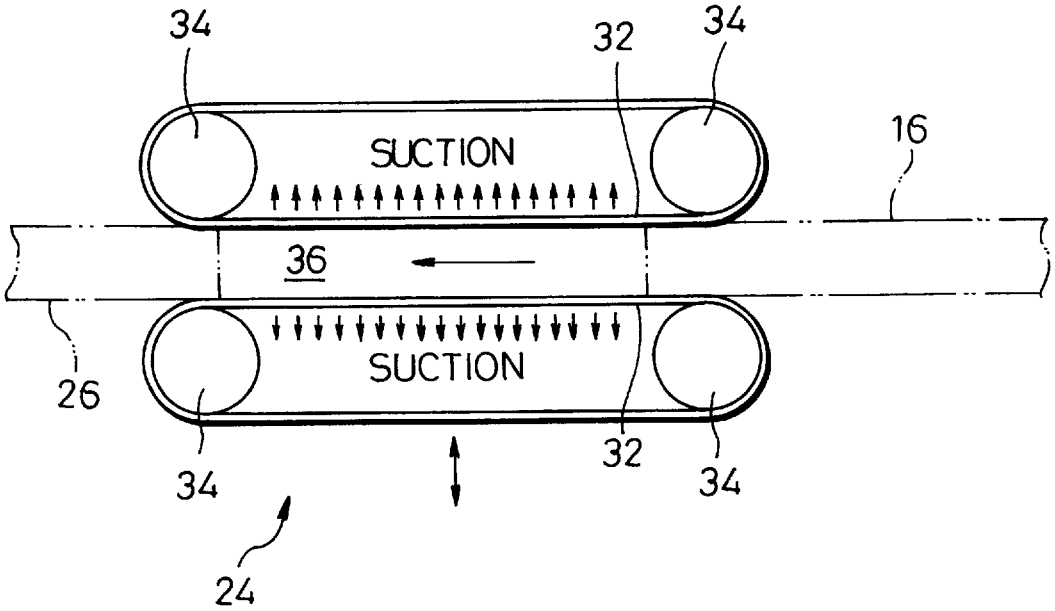
FIG. 3 is a plan view showing a pair of side bands forming inside walls of the reforming passage.

As can be clearly seen from FIG. 3, each of the side bands 32 is one run of an endless suction belt and is extended between a pair of rollers 34 and passed around them. Different from axes of the above drums 18, 28 and the roller 22, axes of these rollers 34 vertically extend. Each of the side bands 32 travels in the same direction as traveling directions of the first and second tobacco bands 16 and 26 and these traveling speeds indicate the above traveling speed $V_2$ of the conveying unit 24.

Here, the above traveling speeds $V_1$, $V_2$, $V_3$ and the height H of the reforming passage 36 satisfy the following relation.

$V_1:V_2:V_3=1.5\sim2.5:1\sim2:1$

Preferably, $V_1:V_2:V_3=1.7:1:1$ is set.

$H=N\times T_1$

Here, $T_1$ is the thickness of the first layer of the shredded tobacco and N is about 2.

Further, one of the side bands 32 located on the access side of an operator with respect to the cigarette manufacturing machine can be moved to and from the other side band 32. Accordingly, the width of the reforming passage 36 can be adjusted and shredded tobacco clogged within the reforming passage 36 can be removed therefrom by moving the one side band 32.

The first tobacco band 16, the collecting band 20, the second tobacco band 26 and the pair of side bands 32 are operated by receiving power from a power transmission system (not shown) of the cigarette manufacturing machine, or are operated by receiving power from an independent electric motor (not shown).

Similar to the first tobacco band 16, the second tobacco band 26 may be replaced with a suction drum. The reforming passage 36 of the conveying unit 24 may be also formed by utilizing the outer circumferential face of a suction drum. In this case, the suction drum has a suction groove formed on the outer circumferential surface thereof. The suction groove has a rectangular or arc shape in transversal section on of the suction drum.

An operation of the supplying device 10 of the shredded tobacco will be explained as follows.

As shown in FIG. 2, a first layer $K_L$ of the shredded tobacco formed on the lower surface of the first tobacco band 16 is continuously supplied to the conveying unit 24 in accordance with traveling of the first tobacco band 16. The first layer $K_L$ is formed by attracting the shredded tobacco blown upward within the chimney 14 onto the lower surface of the first tobacco band 16. Therefore, a large part of the shredded tobacco $K_T$ in the first layer $K_L$ is in a state in which the individual shredded tobacco $K_T$ is laminated with the first tobacco band 16 in a layer form along the lower surface of the first tobacco band 16.

Figure 4:
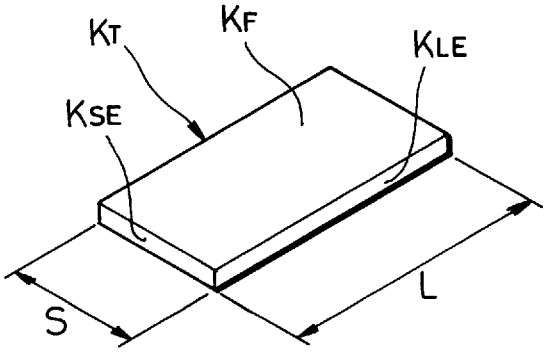
FIG. 4 is a perspective view exaggeratively showing one shredded tobacco.
Figure 5:
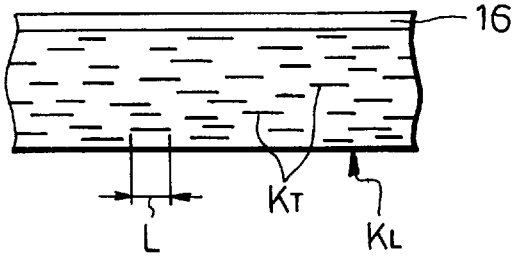
FIG. 5 is an enlarged view of a V-section shown in FIG. 2.

More specifically, the shredded tobacco $K_T$ is obtained by cutting tobacco leaves. Accordingly, as exaggeratively shown in FIG. 4, the individual shredded tobacco $K_T$ is formed in a rectangular shape and has both front and rear faces $K_F$, a pair of long sides $K_{LE}$ having a length L, and a pair of short sides $K_{SE}$ having a length S. Therefore, as shown in FIG. 5, both the faces $K_F$ of the individual shredded tobacco $K_T$ in the first layer $K_L$ are parallel to the lower surface of the first tobacco band 16 and its long sides $K_{LE}$ tend to arrange along the traveling direction of the first tobacco band 16.

Thereafter, the first layer $K_L$ of the shredded tobacco is sent from the first tobacco band 16 into the reforming passage 36 of the conveying unit 24. Here, the height H of the reforming passage 36 is set to be sufficiently larger than the thickness $T_1$ of the first layer $K_L$. Further, with respect to the individual shredded tobacco $K_T$ in the first layer $K_L$, bonding force between these shredded tobaccos $K_T$, i.e., suction is released.

Figure 6:
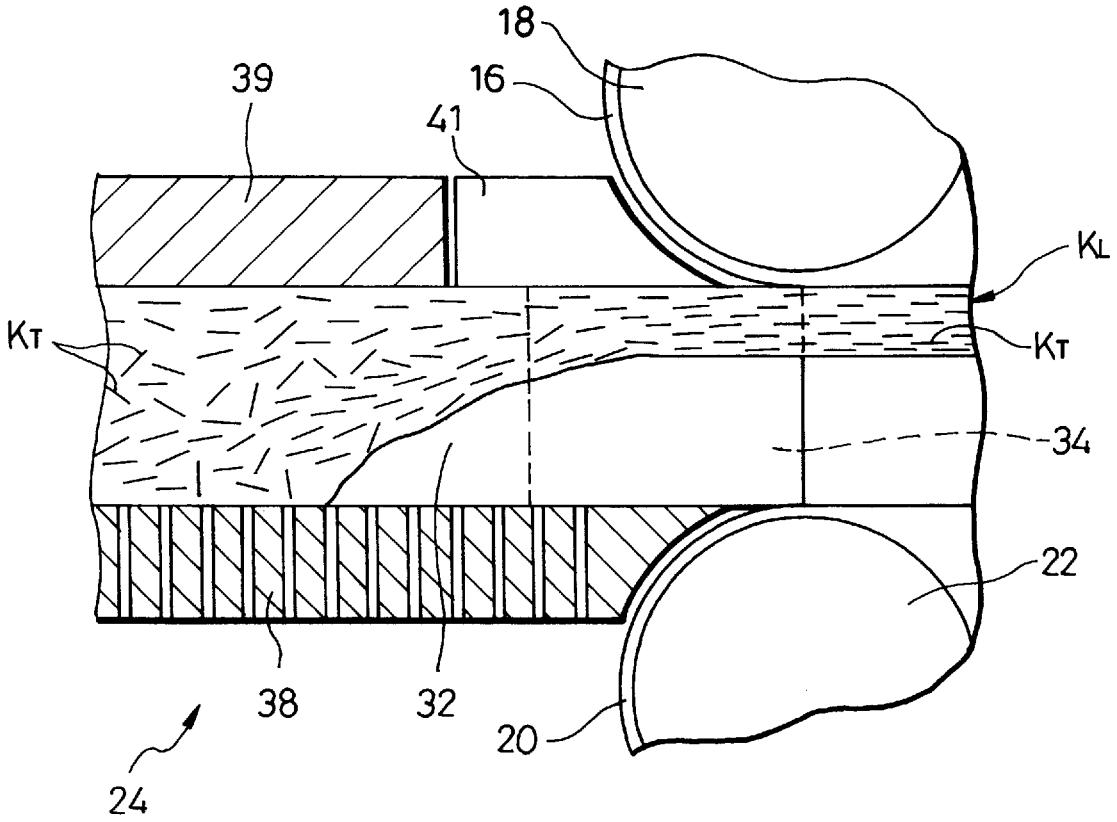
FIG. 6 is an enlarged view of a VI-section shown in FIG. 2.

Therefore, after the individual shredded tobacco $K_T$ of the first layer $K_L$ is once dispersed within the reforming passage 36, the individual shredded tobacco $K_T$ is deposited on the bottom wall 38 of the reforming passage 36 and then fills the cross section of the reforming passage 36. Namely, a second layer $K_C$ of the shredded tobacco $K_T$ is formed in the downstream side portion within the reforming passage 36. As can be clearly seen from FIGS. 2 and 6, the shredded tobacco $K_T$ in the second layer $K_C$ is oriented to an irregular direction by the above dispersion. In FIGS. 2, 5 and 6, the shredded tobacco $K_T$ is simply shown by only a line segment for convenience sake. Therefore, with respect to the shredded tobacco $K_T$ in the second layer $K_C$, there are various shredded tobacco in which both the faces $K_F$ of the shredded tobacco are perpendicular to, inclined with, or parallel to the axis of the reforming passage 36, etc.

Since both inside surfaces of the reforming passage 36 are respectively formed by the side bands 32, the second layer $K_C$ of the shredded tobacco is attracted to the side bands 32 and is then conveyed toward the second tobacco band 26 in accordance with traveling of the side bands 32. The traveling speed $V_2$ of the side bands 32 is lower than the traveling speed $V_1$ of the first tobacco band 16, i.e., the first layer $K_L$ of the shredded tobacco. Accordingly, the shredded tobacco temporarily stays within the reforming passage 36 so that the second layer $K_C$ can be reliably formed.

However, when the traveling speed $V_2$ of the side bands 32 is excessively low, the upstream side portion within the reforming passage 36 is filled with the shredded tobacco so that the shredded tobacco cannot be scattered. In contrast to this, when the traveling speed $V_2$ of the side bands 32 is excessively high, the second layer $K_C$ having the thickness corresponding to the height H of the reforming passage 36 can not be formed and no effects of the scattering of the shredded tobacco can be obtained. Therefore, the traveling speed $V_2$ of the side bands 32 is set to the above range with respect to the traveling speed $V_1$ of the first tobacco band 16. As a result, the inflow rate of the shredded tobacco flowing into the reforming passage 36 is in conformity with the outflow rate of the shredded tobacco flowing from the reforming passage 36.

Here, the thickness of the first layer $K_L$ of the shredded tobacco is adjusted by the pair of trimming disks 17 so that the supplying rate of the shredded tobacco into the reforming passage 36 can be stabilized.

Further, the air passing holes 37 are formed in the bottom wall 38 of the reforming passage 36 so that the air can be guided into the reforming passage 36 through these holes 37. Accordingly, the suction bands 32 can reliably fulfill the attracting function of the second layer $K_C$. Further, the air introduced into the reforming passage 36 through the holes 37 reduces the sliding resistance of the second layer $K_C$ with respect to the bottom wall 38. As a result, the second layer $K_C$ can be smoothly conveyed in the reforming passage 36.

Thereafter, the second layer $K_C$ of the shredded tobacco continuously sent from the reforming passage 36 is received on the lower surface of the second tobacco band 26 and is supplied to the rod forming section 12 in accordance with traveling of the second tobacco band 26. Here, the traveling speed $V_3$ of the second tobacco band 26 is equal to or lower than the traveling speed $V_2$ of the side bands 32 so that the second tobacco band 26 can reliably receive the second layer $K_C$ on the lower surface thereof.

The rod forming section 12 receiving the second layer $K_C$ of the shredded tobacco wraps the second layer $K_C$ in paper P as mentioned above and continuously forms the tobacco rod.

Figure 7:
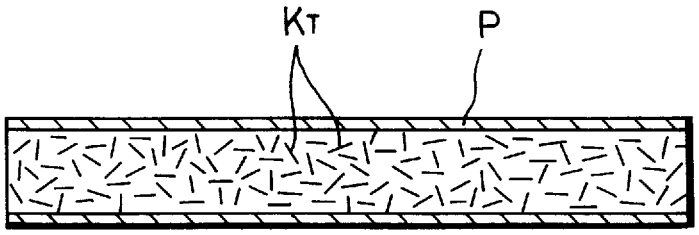
FIG. 7 is a longitudinal sectional view of a formed tobacco rod.

As schematically shown in FIG. 7, the shredded tobacco $K_T$ in the tobacco rod formed as mentioned above is oriented to an arbitrary direction with respect to the wrapping paper P so that the shredded tobacco is arranged at random. Therefore, the shredded tobacco in the tobacco rod is in a mutually entwining state so that the shredded tobacco is strongly held by the wrapping paper P and hardness of the tobacco rod is uniformed in the circumferential direction and is increased in comparison with the hardness of the normal tobacco rod. Accordingly, it is possible to reduce dropping of the shredded tobacco from cutting ends of cigarette rod when cutting the tobacco rod and in subsequent manufacturing process and distributing stage.

As a result, when the same hardness as the normal tobacco rod is approximately obtained, a filling amount of the shredded tobacco in the tobacco rod can be reduced and the dropping of the shredded tobacco from the cutting ends can be also reduced so that physical properties of the cigarette rod can be improved.

Further, since the first layer $K_L$ of the shredded tobacco formed on the first tobacco band 16 is not compressed, crushing of the shredded tobacco in the first layer $K_L$ can be prevented even when the operating speed of the cigarette manufacturing machine is increased. As a result, the above supplying device of the shredded tobacco is suitable for a high-speed operation of the cigarette manufacturing machine.

Figure 8:
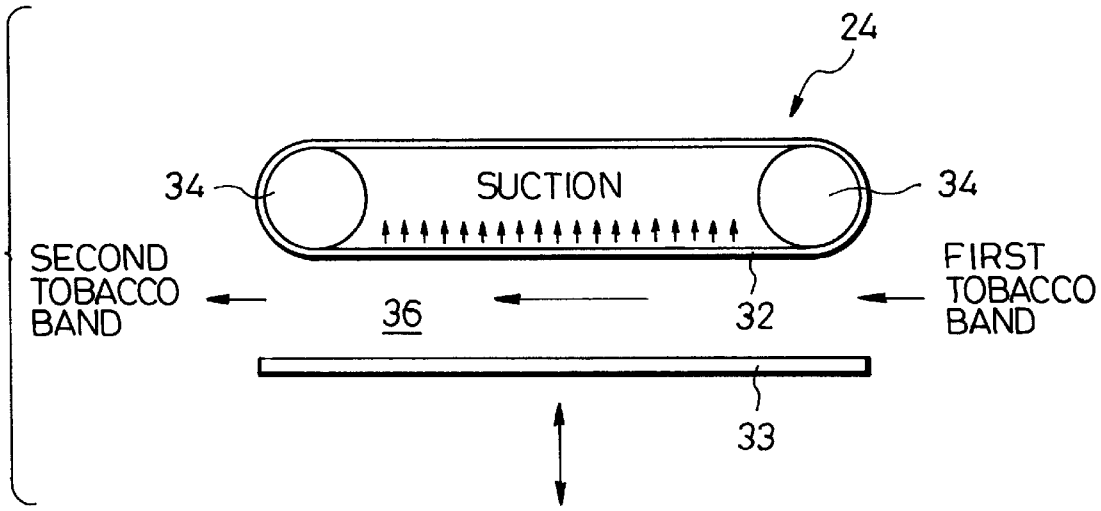
FIG. 8 is a view showing a modified example of the conveying unit.

The present invention is not limited to the above embodiments. For example, with reference to FIG. 8, one of the side bands 32 located on the access side of the operator is replaced with a plate-like guide wall 33. In accordance with such the guide wall 33, the width of the reforming passage 36 can be easily adjusted and the reforming passage 36 can be easily opened.

Figure 9:
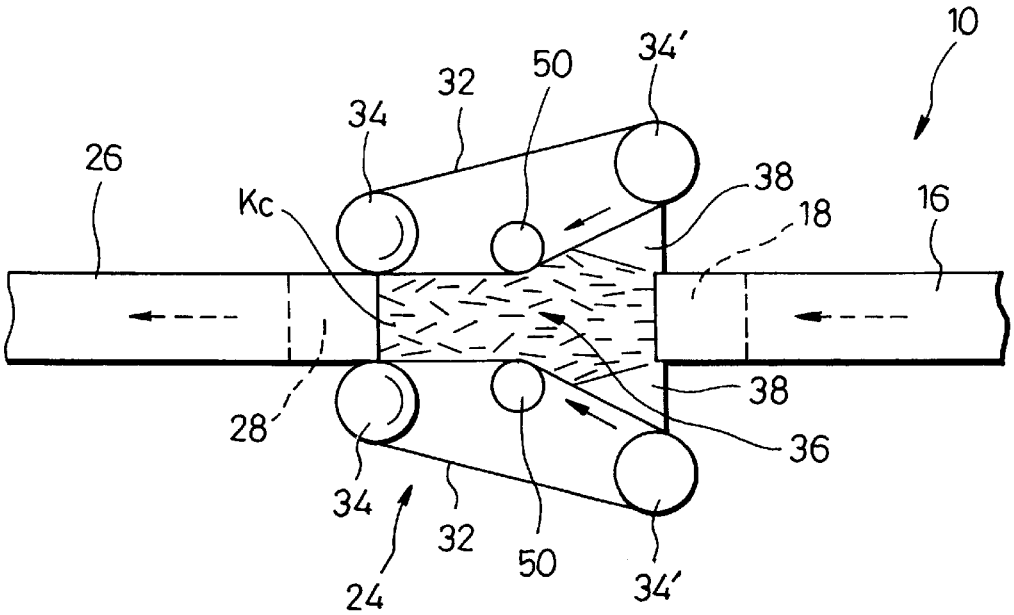
FIG. 9 is a view showing another modified example of the conveying unit.

With reference to FIG. 9, the inlet of the reforming passage 36 is enlarged in a width direction. Namely, the distance between inlet-side rollers 34' for the side bands 32 is greater than the widths of first and second tobacco bands 16 and 26. Each of the side bands 32 is guided by a guide roller 50 in its intermediate portion. Similar to the distance between outlet-side rollers 34, the distance between these guide rollers 50 is set to be equal to the widths of the first and second tobacco bands 16 and 26. Accordingly, the width of the reforming passage 36 is gradually reduced from the inlet toward the guide rollers 50 and is constant from the guide rollers 50 to the outlet. In this case, the bottom wall 38 and the ceiling wall 39 are also widened on left-hand and right-hand sides of the first tobacco band 16 in the inlet portion of the reforming passage 36 due to enlarging the inlet of the reforming passage 36.

In accordance with the above reforming passage 36, the shredded tobacco is effectively scattered in the inlet of the reforming passage 36 since the inlet is enlarged on the left-hand and right-hand sides.

What is claimed is:

1. A supplying device for supplying shredded tobacco to a rod forming section of a cigarette manufacturing machine, comprising:

first conveying means for conveying a first layer of the shredded tobacco, said first conveying means including a first movable suction surface on which the first layer formed by attracting the shredded tobacco in a layer form;

reforming means for receiving the first layer from the first suction surface of said first conveying means and reforming the first layer into a second layer thicker than the first layer, said reforming means including a passage for forming the second layer by dispersing the received shredded tobacco of the first layer and depositing the shredded tobacco after the dispersion thereof, and moving means for moving the formed second layer in said passage; and second conveying means for receiving the second layer from said reforming means and conveying the second layer toward the rod forming section, said second conveying means including a second movable suction surface onto which the second layer is attracted.

2. The device according to claim 1, wherein said moving means includes a suction band forming one side wall of said passage, the suction band moving from the first suction surface of said first conveying means toward the second suction surface of said second conveying means.

3. The device according to claim 1, wherein said moving means includes suction bands forming both side walls of said passage, respectively, the suction bands moving from the first suction surface of said first conveying means toward the second suction surface of said second conveying means.

4. The device according to claim 2, wherein said moving means further includes a guide wall forming another side wall of said passage.

5. The device according to claim 1, wherein said passage includes an inlet for the first layer and an outlet for the second layer, and has a constant width from the inlet to the outlet.

6. The device according to claim 1, wherein said passage includes an inlet for the first layer and an outlet for the second layer, and the inlet has a width wider than that of the outlet.

7. The device according to claim 1, wherein said first conveying means further includes trimming means for adjusting a thickness of the first layer.

8. The device according to claim 1, wherein a traveling speed of the second layer provided by said moving means is lower than a traveling speed of the first layer provided by the first suction surface, and the traveling speed of the second layer in said passage is equal to or higher than the traveling speed of the second layer provided by the second suction surface.

* * * * *